United States Patent [19]

Kicherer et al.

[11] Patent Number: 4,829,279

[45] Date of Patent: May 9, 1989

[54] ELECTRIC SWITCHING DEVICE, OPERABLE FOR POWER CONTROL

[75] Inventors: Robert Kicherer, Oberderdingen; Willi Essig, Boeblingen; Siegfried Mannuss, Sternenfels, all of Fed. Rep. of Germany

[73] Assignee: E.G.O. Elektro-Gerate Blanc u. Fischer, Fed. Rep. of Germany

[21] Appl. No.: 117,033

[22] Filed: Nov. 4, 1987

[30] Foreign Application Priority Data

Nov. 15, 1986 [DE] Fed. Rep. of Germany ..... 3639186

[51] Int. Cl.[4] ..... H01H 61/08; H01H 71/16; H01H 37/12

[52] U.S. Cl. ..... 337/94; 337/57; 337/361

[58] Field of Search ..... 337/57, 82, 94, 347, 337/360, 361, 368, 369, 298

[56] References Cited

U.S. PATENT DOCUMENTS

| | | | |
|---|---|---|---|
| 2,256,732 | 9/1941 | Brown . | |
| 2,673,444 | 3/1954 | Clapp | 60/23 |
| 2,728,842 | 12/1955 | Turner | 219/20 |
| 2,769,060 | 10/1956 | Franklin . | |
| 3,869,688 | 3/1975 | Aldous | 337/82 |
| 3,932,830 | 1/1976 | Holtkamp | 337/94 |
| 3,943,479 | 3/1976 | Turner | 337/347 |
| 4,052,591 | 10/1977 | Sekera, Jr. | 337/361 |
| 4,206,344 | 6/1980 | Fischer et al. | 337/298 |

FOREIGN PATENT DOCUMENTS

| | | |
|---|---|---|
| 1071193 | 12/1959 | Fed. Rep. of Germany . |
| 2204362 | 9/1972 | Fed. Rep. of Germany . |
| 2625715 | 1/1979 | Fed. Rep. of Germany . |
| 3508248 | 9/1986 | Fed. Rep. of Germany . |
| 957873 | 3/1962 | United Kingdom . |

*Primary Examiner*—H. Broome
*Attorney, Agent, or Firm*—Steele, Gould & Fried

[57] ABSTRACT

An electric switching device (1) in the form of a timed power control device with an appliance switch (6) operated by a heated thermobimetal (15) and in the form of a snap switch has an adjusting device (39) for modifying the distance between the opposite contact (36) and the counter-stop (37) for the movable switching contact (34), operated simultaneously with the setting of the different setting ranges of the switching device in such a way that in the low setting ranges the switching hysteresis of the appliance switch (6) is made smaller and in the higher setting ranges larger. Thus, in particular the smaller values of the relative switch on duration of the appliance switch (6) can be set much more accurately, so that there is a very precise power control in the low setting ranges.

47 Claims, 4 Drawing Sheets

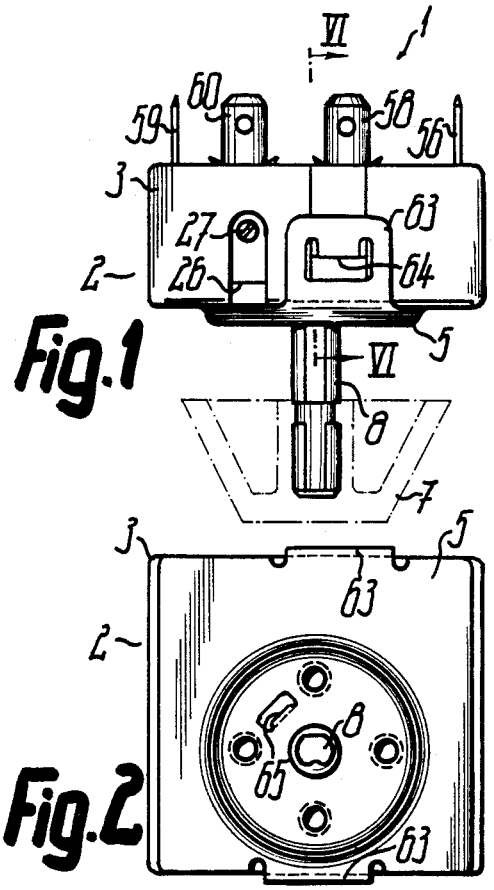
Fig.1
Fig.2
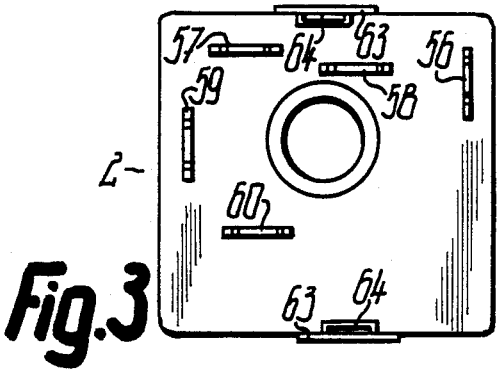
Fig.3

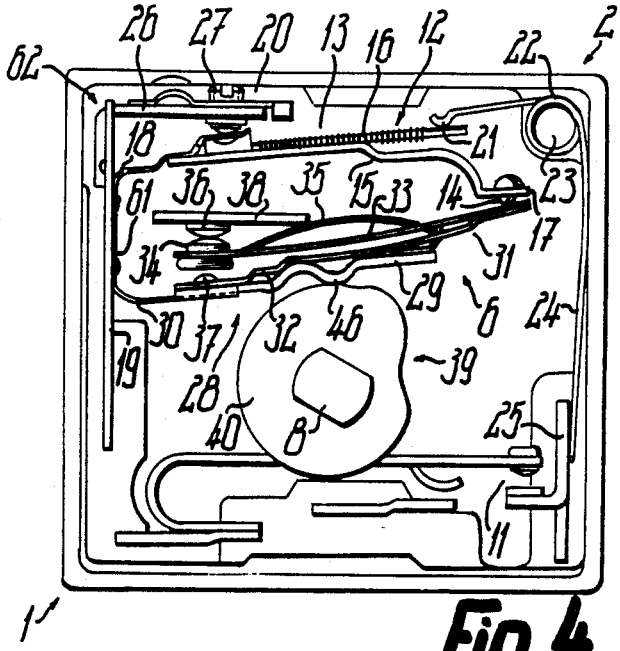
Fig. 4
Fig. 5
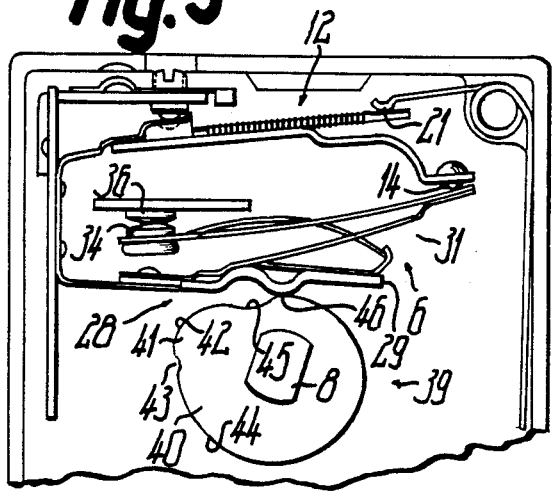

ELECTRIC SWITCHING DEVICE, OPERABLE FOR POWER CONTROL

DESCRIPTION

The invention relates to an electric switching device, particularly for power control purposes for heaters used on thermal appliances.

Particularly in the case of electric switching devices constructed in the manner of power control devices operating in a timed manner, there is a need to keep the click rate (flicker effect), i.e. the number of switching processes taking place per unit of time as low as possible and e.g. below 5 per minute. The know switching devices often have an up to four times higher click rate value. In addition, the interference time measured in milliseconds should be as low as possible with such switching devices, namely e.g. below 10 msec, but the known switching devices provided with a socalled crawler, significantly exceed this value, namely by up to six times. These high values are in particular due to the fact that hitherto no sufficiently simple solution has been fund for obtaining reduced values with a resulting cost that is acceptable.

In electrical switching devices of the aforementioned type, particularly these power control devices operating in a timed manner in which the appliance switch is operated by means of a control loop having a temperature sensor, e.g. a heated thermobimetal, there is a functional dependence or relationship between the switching rate and the relative switch on duration, which is the percentage of the sum of the switch on times in the total time, said function in known switching devices generally being approximately symmetrical to a peak point and the latter is approximately at 50% switch on duration. However, the ratio between the switch on times an the switch off times of the appliance switch or between the switch on time and switch off time of a cycle defined as the sum of these two times is dependent on the size of the switching hysteresis of the appliance switch. Finally, in the first-mentioned function between the switching rate and the relative switch on duration, the click rate maximum in the function curve peak is displaced towards lower values of the relative switch on time if the hysteresis of the appliance switch, particularly as the switch on duration becomes shorter, is made smaller. It can be proved that under these conditions the click rate drops less in the range of the smaller values of the switch on duration. Moreover, an increase in the click rate is necessarily linked with a shortening of the absolute switch off time per cycle duration, so that the values of the switch off times decrease superproportionally compared with those of the switch on times.

The objects of the invention is to provide an electric switching device of the aforementioned type, in which in simple manner it is possible to additionally influence the precision of the values of he relative switch on duration, particularly in the ranges of smaller values, which is dependent on the fixed appliance-specific switching hysteresis. It must also be possible to displace the curve peak of the function of the click rate and the relative switch on duration for any random setting range of the switching device in a desired manner and in particular in the lower setting ranges increasingly towards smaller values of the relative switch on duration.

According to the invention this object is achieved in the case of an electric switching device of the aforementioned type by additionally adjusting the switch-inherent changes of the hysteresis by means of an actuator. By modifying the switching hysteresis, the curve peak of said function of switching rate and relative switch on duration can be displaced in any desired direction with respect to an appliance-typical, fixed position towards higher or lower values of the relative switch on duration and consequently modify the switching rate associated with each setting range of the switching device, so that it is e.g. possible to significantly reduce the click rate and/or the interference duration of the operating switching device.

In the case of an electric switching device intended for domestic appliances or similar appliances to be operated by amateurs, it is desirable that the change to the switching hysteresis determined infixed manner is a function of the variation to the setting range, so that in particular the extra adjustment of the hysteresis is done with the switching actuator of the switching device. With each setting range and therefore each relative switch on duration of the switching device can be associated as a result of the adjusting device an increasingly modified switching hysteresis, particularly towards lower setting values or a significantly reduced value of the switch off times compared with the reduction of the switch on times and in the latter case the important advantage is obtained that the smaller values of the relative switch on duration or the lower setting ranges of the switching device can be much more easily adjusted or set.

A particularly advantageous, simple, functionally reliable, compact and precisely operating further development of the inventive object results from modifying an operating respective motion range of a switching contact. By modifying the switching path of the switching contact, e.g. due to a position change of either the counter contact, the counter stop or both of these parts, it is possible to influence the switching hysteresis in any random way. It would also be conceivable to construct the counter contact and/or counter stop in ledge-like manner in a direction at right angles to the switching movement direction of the switching contact, to arrange these two parts at an angle to one another and to modify the switching path of the switching contact in such a way that one of these t wo parts and/or the switching contact are arranged in position-variable manner for modifying the switching path in the ledge longitudinal direction, if this makes it possible to better utilize the given spatial conditions.

The switching hysteresis and optionally the setting range of the switching device or the switch off point of the appliance switch can be modified in simple manner either by modifying a switch biasing or an actuating characteristic of a switching mechanism, or by a combination thereof.

As it is in most cases desirable for the switching rate to drop less in the direction towards smaller setting ranges that would be the case with a function curve configuration roughly symmetrical to the curve peak between the switching rage and the relative switch on time or that the switching rate drops more rapidly in the direction of higher setting ranges as from a lower setting range, as well as over the remaining higher setting ranges, a particularly advantageous construction results from reducing the hysteresis upon decreases of the relative operating duration by either reducing the motion range of the switch contact or increasing the biasing of the appliance switch or reducing a motion range of an switch actuating element or by any combination of these possibilities. It has proved advantageous if the switching path of the switching contact is variable with the adjusting device between at least 1/10 and max 2 to 3 mm, particularly between approximately 0.2 and max 1.6 mm, preferably approximately 1.2 mm, and in special cases the minimum switching path can be below the indicated minimum value or the maximum switching path can exceed the given maximum value.

According to a further development of the invention, the adjusting device for the switching hysteresis and the setting device for the setting ranges of the switching device are so mechanically coupled that they are at least partly and preferably wholly formed by the same control device. Thus, the dimensions of the appliance switch can be made particularly small both in the direction of the setting spindle and in all directions at right angles thereto. Thus, the adjusting device and the setting device do not have to act by means of separate pressure points on the appliance switch or the switching mechanism and instead it is possible to provide for this a single pressure point with punctiform or linear contact.

Through the choice of the position of the pressure point relative to the remaining contact, stop and pressure points of the appliance switch and the switching mechanism and optionally through the choice of the leverage between these points, it is possible in simple manner to determine the functional dependence between the particular setting range of the appliance switch and the associated switching hysteresis, particularly favourable conditions occurring with locating the switching element and the contact at different lever distances on both sides of an actuating axis.

Although the inventive construction is conceivable for all those switching devices which have a switching hysteresis or in which the appliance switch is influenced by means of a temperature sensor, it is particularly advantageous for electric switching devices internettently switched on and off as function of time.

In order that the appliance switch can be mounted in simple manner and inaccurately pre-adjusted arrangement with respect to the switching mechanism on ab base structure carrying one of these individual groups, the movably operating members of the device are combined to a unit. Appropriately all the parts or assemblies of the switching device to be arranged on the basic structure in the form e.g. of a casing can be fitted from the same side of the structure and in the same direction, particularly by plugging in, so that a fully automatic assembly is particularly simple. The assembly direction is appropriately parallel to the setting spindle.

The inventive electric switching device is appropriately constructed in such a way that the setting spindle can only be transferred from the switch off position after preceding unlocking by an axial movement, particularly an axial movement brought about by pressure on the actuator directed into the basic structure into a first switch on position, whereby the latter can coincide both with the lowest setting range and the with the highest setting range.

Between the highest and lowest setting ranges it is possible to rotate the setting spindle without the locking means coming into action, said locking means automatically reengaging under spring tension on reaching the switch off position. The locking means appropriately has a spring washer arranged in a circular groove of the setting spindle and which is not closed over the circumference in the manner of a circlip and which so cooperates with a circular disk associated with the locking device, that it is pressed by sloping or rising surfaces into its position in the groove of the setting spindle by the tension of a return spring and is therefore constantly secured in position. The locking element in the form of a locking cam which is fixed with respect to the basic structure is appropriately in one piece with part of the latter, preferably with a sheet metal outer casing cover, which can be constructed as a mounting plate for fixing the switching device to an instrument panel, for position securing of a structure cover or the like closing the cup-shaped casing structure on the open assembly side. The locking device is appropriately substantially virtually completely screened to the outside between said casing cover and the covering, so that a high functional reliability is ensured because the locking device is protected against dirt and pollutants.

These and further features of preferred developments of the invention can be gathered from the description and drawings, it being possible to realize the individual features alone or in the form of subcombinations in a embodiment of the invention and in other fields.

BRIEF DESCRIPTION OF THE DRAWINGS

An embodiment of the invention is represented in the drawings, wherein show:

FIG. 1 A view of an inventive electric switching device.

FIG. 2 The switching device according to FIG. 1 in a view of the front.

FIG. 3 The switching device of FIG. 1 in a view of the rear.

FIG. 4 The switching device in the view according to FIG. 2, but with the casing opened and on a larger scale.

FIG. 5 The switching device in a detail corresponding to FIG. 4, but with a different setting.

DETAILED DESCRIPTION OF THE PREFERRED EMBODIMENTS

Figure 6:
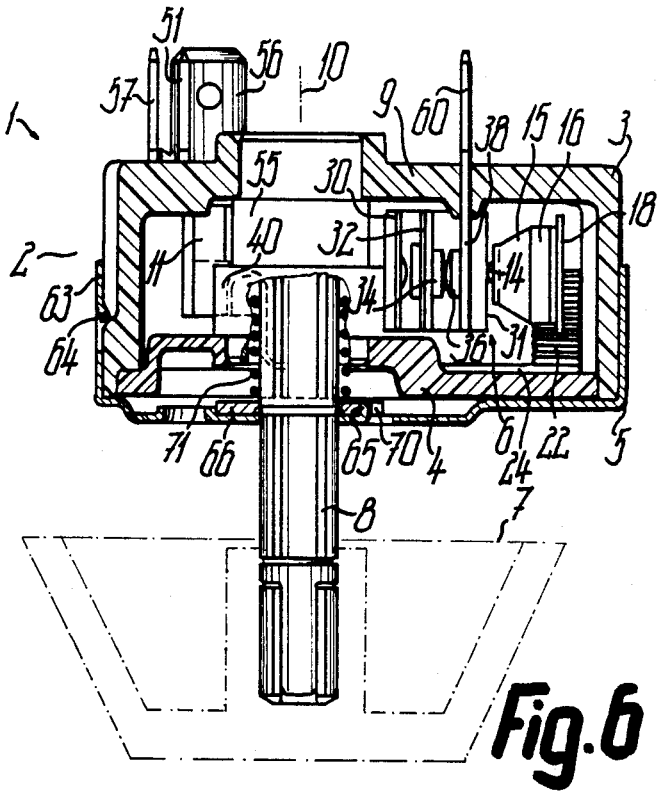
FIG. 6 A section roughly along line VI/VI in FIG. 1 and on a larger scale.
Figure 7:
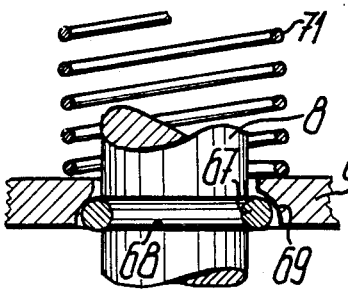
FIG. 7 A detail of FIG. 6 on a larger scale.

In a view of the all the outsides, the electrical switching device according to FIGS. 1 to 6 has a substantially rectangular basic structure 2 forming an approximately closed casing, which is formed by a substantially cup-shaped insulating material casing body only open to its full width at the front, an approximately plate-like, planar insulating material casing cover 4 resting in substantailly flush manner on the inner shoulders of the casing structure 3 and substantailly closing the open side of the latter, as well as a securing lid 5 made from sheet metal or the like, which substantially completely covers the outside of the casing cover 4 and is so engaged with structure 3 by means of resilient snap connections that it secures the casing cover 4 in its closed position.

In the casing area surrounded by the basic structure 2 and which in a view of the front is approximately square and is e.g. approximately two thirds flatter than the associated edge dimension is arranged an appliance switch 6 constructed as a snap switch, which by means of an actuator 7 constructed as a toggle member located externally on the front of the basic structure 2 can be transferred via a setting spindle 8 traversing at right angles the front surface into a switch off position and in continuous manner into different switch on positions, which are associated with different power setting ranges of the switching device 1. The setting spindle 8 is rotatably mounted about its central axis 10 substantially exclusively in base wall 9 and in the wall of the securing lid located on the front surface. For multipole or all-pole disconnection, the switching device 1 is provided with at least one further break contact 11 located in the casing area. The appliance switch 6 is appropriately located on one side of setting spindle 8 between the latter and a first lateral casing wall and the break contact 11 is located on the opposite side of the setting spindle 8 between the latter and a second lateral casing wall in such a way that the spindle 8 between the appliance switch 6 and the break contact 11 is closer to the second casing wall and roughly in the centre between the two further lateral casing walls roughly at right angles thereto, namely a third and a fourth lateral casing wall. The longitudinal extensions of the appliance switch 6, a switching mechanism 12 located between the latter and the first casing wall and closely adjacent to the latter and the break contact 11 are approximately parallel to one another and to the first and second casing walls. Appliance switch 6, switching mechanism 12 and break contact 11 extend approximately up to the third and fourth casing walls.

The switching mechanism 12 switched by the appliance switch 6 has a switching element 14 acting on appliance switch 6 and controlled by a temperatuae-dependent control loop via a switching member 13. The thermomechanical switching member 13 is substantially formed by an elongated thermobimetal 15 stepped several times in the direction of the appliance switch 6 from a rear straight or planar end portion. Engaging on approximately the entire width of the rear end portion of the thermobimetal 15 is so arrange or fixed in good thermally conducting connection a heating resistor 16 wound on a lamellar insulating support that said heating resistor is located on the side of thermobimetal 15 remote from the appliance switch 6. Thermobimetal 15 passes from the rear end portion via a first offset into an intermediate portion, which in turn passes via an approximately quadrantal portion curved towards the appliance switch 6 into an end portion 17 approximately parallel to the other end portion and forming its free end and which carries the spherical cup-shaped switching element 14 e.g. formed by a rivet head. Heating resistor 16 which is shorter than the thermobimetal 15 projects freely in the direction of end portion 17 over the intermediate portion of themobimetal 15 which is approximately parallel to the rear end portion. Switching mechanism 12 or thermobimetal 15 is mounted in the manner of a freely projecting control lever on the rear end adjacent to the third casing wall in resiliently articulated manner about a joint axis approximately parallel to the central axis 10 of the setting spindle 8 by a spiral joint formed by a spiral spring 18 that the switching element 14 is loaded counter to its movement directed against the punctiform engagement on the appliance switch 6. The spiral joint is formed in the transition region between the two legs of the angular spiral spring 18 which are approximately at right angles to one another. One leg, which is U-shaped at the end and fixed a the side of the rear end portion of thermobimetal 15 remote from appliance switch 6 carries essentially the entire switching mechanism 12 and it is fixed with the outside of the other leg to a strip-like or plate-like support body 19 by rivets or the like and which is in turn secured directly adjacent to the third casing wall and parallel thereto exclusively by insertion in slits in casing body 3. At its end projecting over the spiral spring 18 in the direction towards the first casing wall, support body 19 also carries a compensating device 20, which serves for the automatic readjustment of the switching mechanism 12 or the switching element 14 as a function of the particular ambient temperature, so that the latter does not modify the desired power setting associated with each rotary position of the setting spindle 8.

At the freely projecting end remote from the joint axis, heating resistor 16 is electrically connected by means of a connecting member 21 engaging thereon and moving in a rubbing manner. Member 21 is constructed in the manner of a ski through the bent end of a spring leg pressing member 21 constantly and resiliently against the heating resistor 16. This spring leg appropriately forms the roughly linear end of a helical spring clip, which is closer to base wall 9 and approximately parallel to heating resistor 16 and which is secured by mounting a coil portion on a support mandrel 23 constructed in one piece with the casing body 3 and is so located in the corner between the first and fourth casing walls that its leg forming connecting member 21 projects freely counter to heating resistor 16. On the side of heating resistor 16 remote from the thermobimetal 15, connecting member 21 is immediately adjacent to the first casing wall. The other, much longer and also approximately linear spring leg 24 of the spiral spring clip 22 is immediately adjacent to the inside of the fourth casing wall and in the manner of a sliding contact contacts with its free end the outside of the longer leg of an angular support 25 for the casing-fixed contact element of break contact 11, so that the heating resistor 16 can also be connected in all-pole manner. The spring leg 24 is located between the inside of the fourth casing wall and the associated leg of support 25, from which the other leg projects towards the other casing wall and on its inside facing the appliance switch 6 carries the associated contact element.

Compensating device 20 has an angular thermobimetal 26 with a longer leg freely projected from support body 19 roughly in the same direction as switching mechanism 12 and which is located between the rear end portion of thermobimetal 15 or heating resistor 16 and the first casing wall and in the vicinity of its free end is supported by means of a spherical cup-shaped transfer surface in approximately punctiform manner on the outside of the crossweb of the U-profile-shaped end portion of the associated leg of the spiral spring 18 and therefore on the rear end of switching mechanism 12. The transfer surface is formed by the end surface of an adjusting member 27 constructed as a setscrew, which is accessible through an opening in the associated first casing wall from outside the basic structure 2 and traverses the thermobimetal 26, so that the compensating device 20 is simultaneously integrated with an adjusting device, by means of which the complete switching device can be adjusted in a basic setting. The other, shorter leg of the thermobimetal 26 is fixed on the side of support body 19 remote from switching mechanism 12, so that the compensating device 20 forms a closed assembly with the switching mechanism 12.

Appliance switch 6 has an intrinsically dimensionally stable base part in the form of a support 28, which is essentially formed by a support lever 29 projecting freely in the manner of a one-armed lever and which is shaped from a flat material strip. The support lever 29 extending in the same direction as the switching mechanism 12 and in its central setting position being approximately parallel thereto, i.e. under an acute angle towards its free end it slightly approaches the first casing wall and has two roughly identically long, approximately aligned and approximately linear end portions, between which is provided a corrugated or flat S-curved intermediate portion. The rear end portion of support lever 29 which is roughly at the same distance from the third casing wall or support body 19 as the rear end of the thermobimetal 15 is fixed to a leg of a spiral spring 30 approximately parallel thereto and which receives said end portion with a U-bent end from the side facing the setting spindle 8 over part of its length. The other leg of the spiral spring is also fixed to support body 19 and namely on the same side as spiral spring 18 using rivet or the like. Support 28 is resiliently pivotably mounted with respect to base structure 2 about a joint axis parallel to the joint axis of the switching mechanism 12, the two joint axes being located approximately in a common plane parallel to the axial plane of the setting spindle 8 and which is approximately at right angles to the longitudinal direction of the appliance switch 6 or the switching mechanism 12 or parallel to the third and fourth casing walls, as well as the support body 19. The joint axis of support 28 is also formed by the transition region between the two spring legs of the spiral spring 30, so that in any position support 28 is springloaded in the direction of setting spindle 8 or towards the switch on position of appliance switch 6. The latter has a two-part snap spring 31 with two substantailly parallel hair-pin-like legs 32, 33 adjacent to one another with limited spacing over most of their length and which in the vicinity of the switching element 14 are joined to a pressure plate engaging on one another, being interconnected e.g. by spot welding and project freely from said pressure plate projecting over the front end of the support lever 29 counter to the latter at least over part of the length thereof. In the vicinity of the free end of the leaf-spring leg 33 more remote from support 28 or setting spindle 8, snap spring 31 has a movable switching contact 34 e.g. in the form of a rivet element projecting by in each case one head over the two sides of the leg 33. Between switching contact 34 and switching element 14 leg 33 forms an arcuately curved snap member 35, whose convex curvature side is remote from support 28 and faces the switching mechanism 12 and its end facing switching contact 34 passes in one piece into leg 33 and whose other, free end is supported under pretension in the manner of a knife-edge support bearing in an abutment fixed with respect to support 28 and which is shaped from the other leg 32 of snap spring 31, so that there is no need to provide support 28 with such an abutment. The abutment is located in the vicinity of the free end of support lever 29 and is displaced with respect thereto in the direction of legs 32, 33 of snap spring 31. The convex contact surface of switching contact 34 faces a correspondingly curve opposing contact surface of the base structure-fixed opposing contact 36, provided on the side of support 28 remote from setting spindle 8 substantially between snap spring 31 and switching mechanism 12. The other head of the switching contact 34 provided as a stop on the side of leg 33 remote from the opposing contact 36 is faced by a counter-stop 37 also with a convex stop face and can be formed in simple manner by the head of a fixing member, such as a rivet or the like, with which the associated end of leg 32 and therefore snap spring 31 as a whole is fixed to the rear end of support 28 and said same fixing member can simultaneously be used for fixing support 28 to spiral spring 30. Due to the fact that the counter-stop 37 is arranged on the support 28 mounted in positionally variable manner on base structure 2 with respect to the opposing contact 26, the counter-stop 37 is also positionally variable with respect to the basic structure 2. Opposing contact 36 is secured on base wall 9 by a plate-like support 38 roughly parallel to the first casing wall and projecting freely into the casing area. The switching path of switching contact 34 is determined by the spacing between the opposing contact 36 and the counter-stop 37.

For modifying the switching path and therefore for mechanically varying the switching hysteresis of the appliance switch 6, an adjusting device 39 is provided, which is directly formed by the setting device for modifying the power setting range of the switching device 1. Adjusting device 39 has a cam disk 40 arranged on the setting spindle 8 within the casing area, which is connected in non-rotary manner to the setting spindle 8 and in the represented embodiment is provided with a circumferential cam instead of e.g. a face cam and for setting the different setting ranges and the dependent changing of the switching hysteresis, has different radial spacings from the central axis 10. The curved path of adjusting device 39 has a switch off curved portion 42, which is formed by a cam-like projection extending over an arc angle of approximately 30° about central axis 10, which is approximately symmetrically convexly curved and constructed in such a way that its apex has the greatest radial spacing of the curved path from the central axis 10. Counter to the rotation direction of the setting spindle 8 provided for transferring from the switch off position for passage into the lowest setting range, i.e. counterclockwise in the represented embodiment, to the associated flank of the switch off curved portion 42 is connected a small switch on curved portion 43 constructed in the manner of a concave locking depression, which corresponds to the lowest power setting range of the switching device 1. To this switch on curved portion is connected in the same rotation direction a setting range curved portion 44, which extends over most of the circumference of the cam disk 40, e.g. cover an arc angle of at least 240° and constantly approaches the central axis 10 in the manner of a spiral curve of a circular path eccentric to central axis 10. This setting range curved portion 44 passes on the side of cam 41 remote from the switch on curved portion 43 passes into its associated flank via an end position curved portion 45, which can also be constructed in the manner of a concave locking depression and corresponds to the highest setting range of the switching device 1. Locking depressions can also be provided in the top region of cam 41 or in the setting region curved portion 44, e.g. on its zone corresponding to the central setting, so that on operating the actuator 7 there is a perceptible, but easily overcomable arresting action. The cam disk 40 can be constructed in such a way that it can be operated in only one rotation direction, in particular in the direction for transferring to the lowest setting range out of the switch off position or, as shown, can be operated from the switch off position in both rotation directions, i.e. directly towards the highest setting range.

For mechanically influencing the switching hysteresis of the appliance switch 6 or for modifying the switching path of switching contact 34, as well as for modifying the switching path of switching element 14 extending up to the switching process, as well as for modifying the pretension of snap spring 31 or snap member 35 decreasing in the direction towards the higher setting ranges, the movable part of the appliance switch 6 is supported at one point in punctiform or linear manner on the curved path of cam disk 40 via a runner 46 constructed in the manner of a ski and under resilient pressure and said point is roughly located in the same axial plane of the cam disk 40, which is approximately at right angles to the support 28 in the central position. Runner 46 is provided directly on support 28 or is formed by the latter and can be the curved portion of the S-shaped intermediate portion connected to the front end portion, so that no separate part is required. Measured at right angles to said axial plane, runner 46 is located at e.g. a one third smaller distance from the counter-stop 37 than from the pressure point of switching element 14 and between said two parts.

The switching device 1 operates in the following way. In the switch off position the switching contact 34 is located opposite to opposing contact 36 in contact-free manner in the stop position on counter-stop 37. After transferring the setting spindle 8 into a switch on range position, the switching contact 34 is transferred into its closed position engaging on opposing contact 35 via a lever action acting thereon between switching element 14 and runner 46 and apart from the electrical appliance to be controlled by the switching device also switches on the heating resistor 16. through the heating of the thermobimetal 15 via heating resistor 16, switching element 14 is deflected with respect to its engagement on compensating device 20 and spiral spring 18 in the direction of its engagement movement on the pressure plate of snap spring 31 until the dead centre of the bistable snap spring 31 provided as the switching point is reached and this jumps resiliently in the direction of the other end position, whereby switching contact 34 is released from opposing contact 36 and engages with the counter-stop 37. As a result of the thus opened switching contact 34, heating resistor 16 is also currentless, so that the thermobimetal 15 cools again and returns towards its initial position until the associated dead centre of snap spring 31 is reached and then the snap spring 31 correspondingly jumps again in the direction of the first end position and in resilient manner, so that switching contact 34 is returned to its closed position, so that an operating/switching cycle extending over a predetermined period is ended. By adjusting the runner 46 or support 28, it is possible to modify both the deflection path of the switching element 14 until reaching the dead centre position of snap spring 31 and also the spacing of counter-stop 37 from opposing contact 36 and therefore the switching path of switching contact 34. The higher the setting range, the greater must be the deflection path of the thermobimetal 15 taking place under the heating action of the heating resistor 16, in the sense of engaging the runner 46 with the cam disk 40.

Figure 8:
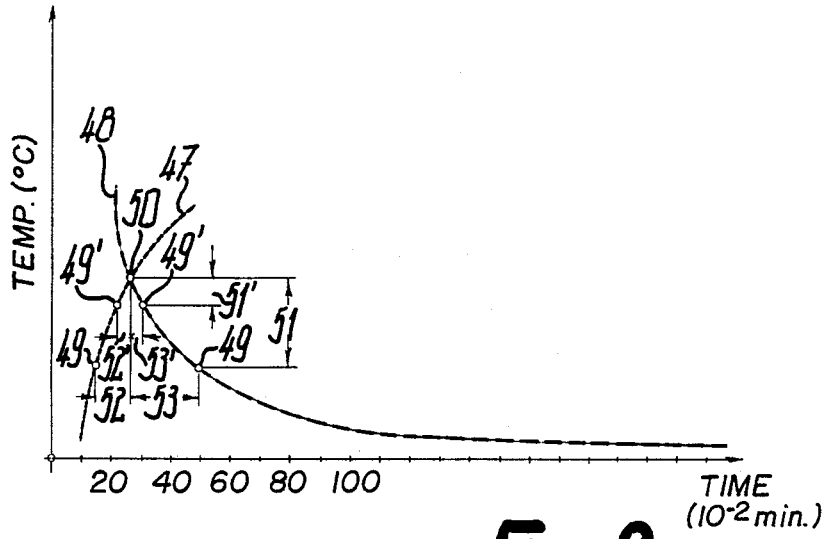
FIG. 8 A graph of the switching hysteresis of the switching device.

In FIG. 8 on the vertical axis is plotted the deflection or the correlating temperature of the thermobimetal 15, whilst on the horizontal axis the time is plotted. During the heating of thermobimetal 15 by heating resistor 16 there is e.g. a heating curve 47, which rises steeply in relatively slightly decreasing manner. On cooling the thermobimetal 15 after switching off the heating by heating resistor 16, there is a cooling curve 48, which initially drops relatively steeply and then in an increasingly shallow manner. In time operation, the switch on point of the appliance switch 6 and therefore the switching on of heating resistor 16 is approximately at 49 on heating curve 47, whilst the switch off point is roughly at 50 thereon, from which emanates the cooling curve 48 until it has again reached the temperature level of the switch on point and the temperature on a further heating curve again rises to the next switch off point. The temperature difference between switch point 49 and switch off point 50 determines the switching hysteresis 51 of appliance switch 1 in the designated 52 and the associated switch off time 53, the later being greater than the switch on time 52 as a result of the specific curve path. The sum of the switch on time and the switch off time gives the period of a switching cycle. The ratio of switch on time 52 to switch off time 53 is, as a result of the non-linear curve path, dependent on the size of the switching hysteresis 51. If switching hysteresis 51 is reduced to switching hysteresis 51', then both the absolute value of the switch on time 52' and switch off time 53' changes and also there is a change in the ratio of these two values with respecd to one another, so that the switch on time 52' becomes greater than the switch off time 53'.

Figure 9:
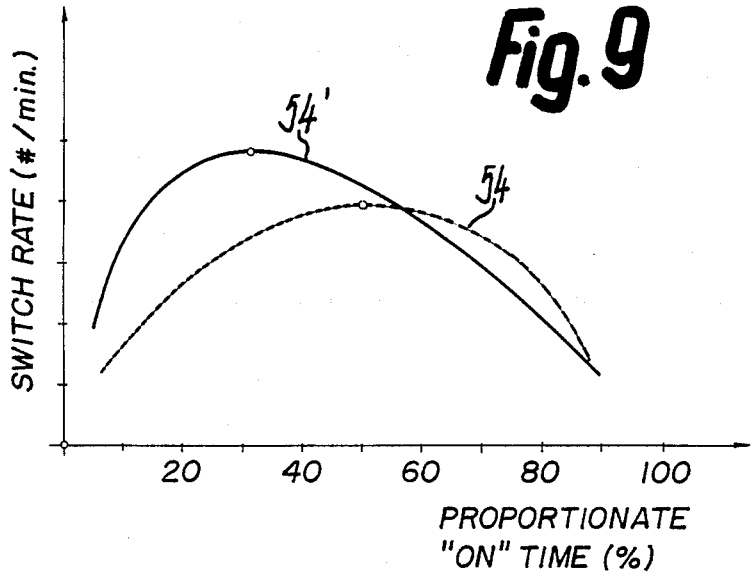
FIG. 9 A graph of the dependence between the switching rate and the relative switch on duration in the case of a switching device according to FIGS. 1 to 7 on the one hand and a switching device with a not additionally variable switching hysteresis on the other.

In FIG. 9 on the vertical axis is plotted the click rate, i.e. the number of switching operations per minute, whilst on the horizontal axis is plotted the relative switch on duration of a switching appliance as a percentage, which results from the switch on time multiplied by 100 and divided by the period or cycle time. One function curve 54 e.g. corresponds to switching hysteresis 51 and has its high point at an approximately 50% relative switch on duration. The other function curve 54' e.g. corresponds to switching hysteresis 51', the apex thereof being displaced towards lower values of the relative switch on duration. As is also shown by FIG. 9, the click rate at the apex of function curve 54 is lower than at the apex of function curve 54'. An increase in the click rate necessarily decrease the switch off times 53'. According to FIG. 8 this has the consequence of switch on point 49' being displaced into the steeper part of cooling curve 48, so that the switch off times decrease super-proportionally in the described manner, so that then small values of the relative switch on duration can be set much more accurately. The necessary change to the switching hysteresis 51, 51' as a function of the relative switch on duration is brought about by adjusting device 39, which increases the switching rate in the lower setting ranges mechanically, in the same way as with a diode circuit.

Immediately adjacent to the cam disk 40 or between the latter and base wall 9, setting spindle 8 carries a cam 55 for operating break contact 11.

All the electrical connections for the switching appliance are in the form of flat plugs projecting form the base wall 9 of basic structure 2. The longer leg of support 25 of the fixed contact element of break contact 11 projects over the outside of base wall 9 together with a connection 56 constructed in one part therewith. The support of the movable contact element of break contact 11 projects with a connection 57. A further fixed contact element with a projecting connection 58 can be provided, which s simultaneously switched with break contact 11 by the movable part thereof. Support body 19 projects over base wall 9 with a connection 59 constructed in one piece therewith and support 38 projects with a connection 60 constructed in one piece therewith. Heating resistor 16 receives its power supply via connection 60, opposing contact 36, switching contact 34 engaging thereon, snap spring 31, support lever 29, spiral springs 30, 18 connected in one piece or support body 19, because these parts are electrically conductively interconnected, the lead being switched by appliance switch 6. The other lead is connected by the leg spring 22 across support 25 to connection 56, so that there is also an all-pole separation of heating resistor 16 when the setting spindle 8 is in the switch off position.

The two spiral springs 18, 30 are formed by a substantially U-shaped leaf spring, which is fixed by its U-shaped cross member 61 to support body 19, so that the latter, apart from opposing contact 36 with the associated support 38, carries the entire remaining appliance switch 6 and, other than the electrical connection formed by leg spring 22, the complete switching mechanism 12, as well as the complete compensating device 20 and with said functional groups forms a closed constructional unit 62, which is solely secured in basic structure 2 by support body 19. The latter is secured on basic structure 2 by insertion in corresponding casing slots from the open side of basic structure 2 and by the engagement of its connection 59 in a corresponding passage slot in base wall 9. Correspondingly the support of the movable and fixed contact element of break contact 11 is secured by insertion in slots in the same plugging direction and by the engagement of its connections 56, 57, 58 in passage slots of base wall 9. Support 38 of the opposing contact 36 is also secured in this way on basic structure 2.

The two facing snap clips 63 of securing lid 5, whereof one is located alongside the passage opening for adjusting element 27, have punched-out, barb-like, inwardly projecting claw clips 64 which engage behind corresponding outer shoulders on the side walls of casing body 3. With a relatively small radial spacing adjacent to the axial passage for the setting spindle 8, a locking cam 65 is shaped out of the end wall of a circular, cup-shaped area shaped out of the securing lid 5 and whose cup opening faces the casing body 3 and said cam projects inwards over said end wall in the form of a punched out and bent clip. On the inside of said end wall the setting spindle 8 is surrounded by a circular disk 66, which is engaged in non-rotary manner with the setting spindle 8, but which can be axially inwardly moved from a stop position adjacent to the outer end of setting spindle 8 and fixed with respect to the latter. Setting spindle 8 is provided in a circular groove 68 with as top ring 67 in the form of a spring washer bent in circular manner from a spring wire and which snaps into the circular groove 68. As a stop face the circular disk 66 is provided in the vicinity of its passage for the setting spindle 8 with an inner, annular stop shoulder 69, which is widened in funnel-shaped manner towards the outer end of setting spindle 8, e.g. is cross-sectionally conically or concavely arcuately profiled, its smaller diameter being smaller than the external diameter of stop ring 67 and its largest diameter in the end face facing the end wall of securing lid 5 is larger than the external diameter of stop ring 67. At one circumferential point, the circular disk 66 also has a locking opening 70 for the engagement of the locking cam 65, which is so arranged that it is only aligned with the locking opening 70 in the switch off position of setting spindle 8 and is provided in the manner of an axial groove on the outer circumference of circular disk 66. The setting spindle 8 is axially displaceable with respect to basic structure 2 counter to the tension of a return spring 71. Return spring 71 which is substantially located within basic structure 2 surrounds in the manner of a helical compression spring the setting spindle 8 and is supported with the associated end on the inner end face of circular disk 66, so tha the setting spindle 8 can be pressed in roughly by the height of the locking cam 65 into basic structure 2 counter to the tension of return spring 71. Setting spindle 8 is also axially displaceable with respect to the cam disk 40 and cam 55, but is coupled in position-locked manner, so that during the axial movement of the setting spindle they remain stationary with respect to the basic structure 2. Return spring 71 engages in cam disk 40. As a result of the inventive construction there is an extremely compact form of switching device 1, because all the components are closely juxtaposed both in the axial direction of the setting spindle and at right angles thereto. On forcing in the setting spindle 8, the stop ring 67 entrains the circular disk 66 via stop shoulder 69 counter to the tension of return spring 71 until the locking cam 65 is disengaged from the locking opening 70 and therefore the setting spindle 8 can be rotated. Outside the switch off position, the locking cam 65 slides on the associated end face of circular disk 66. As a result of the shape of stop shoulder 69, the stop ring 67 is radially inwardly compressed under the tension of return spring 71, so that it can be constantly pressed into circular groove 68 and cannot be disengaged with respect to the setting spindle 8. The locking cam 65 ensures that switching device 1 can only be switched on by pressing setting spindle 8.

We claim:

1. An electric switching device (1) operable for power control of heating means on thermal appliances, said switching device comprising:

a basic body (2);

an appliance switch (6) mounted on said body for directly powering said heating means, said appliance switch (6) being intermittently operated by an automatically operating switching mechanism (12), said appliance switch (6) being adjustable by means of a manual actuator (7) to different individual switching levels of said heating means, said switching levels defining a switch-on temperature (49) and a switch-off temperature (50) for each individual switching level;

the appliance switch (6) having means cooperating with said switching mechanism 912) to change the particular individual switching level, wherein a manually-operable adjusting device (39) is provided for additionally adjusting the switching hysteresis with the manual actuator (7).

2. A switching device according to claim 1, wherein the manual actuator for the adjusting device (39) is formed by the manual actuator (7) of the switching device (1), said manual actuator being located to be externally accessible for concurrent operation of the adjusting device.

3. A switching device according to claim 1, wherein a setting spindle (8) is provided for adjusting said appliance switch (6), said handle being located at an end of the setting spindle (8).

4. A switching device according to claim 1, wherein the appliance switch (6) has a switching contact (34) movably arranged along an extension of a switching path between switching positions, namely a switch on position associated to a counter contact (36) and a switch off position, said adjusting device (39) being provided for modifying said extension of the switching path.

5. A switching device according to claim 4, wherein a counter-stop (37) is provided for limiting the switching contact (34) in the switch off position, said counter-stop being arranged at a spacing with respect to the counter contact (36), said adjusting device (39) being provided for modifying the spacing between the counter contact (36) and the counter-stop (37).

6. A switching device according to claim 1, wherein said appliance switch defines a switching contact operated between switching positions,s aid switching contact (34) of the appliance switch (6) being loaded by a switching spring (31) against at least one of said switching positions.

7. A switching device according to claim 6, wherein said switching contact (34) of the appliance switch (6) is loaded by a bistable snap switch (31) against two switching positions.

8. A switching device according to claim 6, wherein said adjusting device (39) is provided for modifying a pre-tension of said switching spring (31).

9. A switching device according to claim 1, wherein said appliance switch provides a switching contact operated between switching positions, said switching meachnism (12) having a switching element (14) engaging said switching contact (34) of the appliance switch (6), said switching element being movable over an extension of an operating path, said adjusting device (39) being provided for modifying said extension of the operating path of the switching element (4).

10. A switching device according to claim 9, wherein the switching element (14) is supported in a pressure point on the switching spring (31).

11. A switching device according to claim 1, wherein the appliance switch (6) determines a quotient of a relative switch on duration, said quotient providing a decrease and an increase dependent on changes in adjustment of the appliance switch (6), said adjusting device (39) being provided for reducing the switching hysteresis (51, 51') upon the decrease of the relative switch on duration.

12. A switching device according to claim 11, wherein said appliance switch provides a switching contact operated between switching positions, said adjusting device (39) being provided for reducing the switching path of said switching contact (34) upon decrease of the relative switch-on duration.

13. A switching device according to claim 11, wherein said adjusting device (39) is provided for increasing the pre-tension of the switching spring (31) upon the decrease of the relative switch on duration.

14. A switching device according to claim 11, wherein said adjusting device (39) is provided for reducing the operating path of the switching element (14) upon the decrease of the relative switch on duration.

15. A switching device according to claim 1, wherein the appliance switch (6) is constructed as a snap switch.

16. A switching device according to claim 4, wherein the adjusting device (39) is provided for varying the switching path of switching contact (34) between substantially 0.2 and 1.2 mm.

17. A switching device according to claim 1, wherein said adjusting device (39) has a cam disk (40) adjustably supporting a support (28) movably arranged on the basic body (2), said support bearing at least one of a number of components formed by the counter-stop (37), the switching spring (31) and the switching contact (34).

18. A switching device according to claim 17, wherein the cam disk (40) is arranged directly on a setting spindle (8) varying said manual actuator.

19. A switching device according to claim 17, wherein the cam disk (40) is a circumferental cam disk.

20. A switching device according to claim 1, wherein the basic body (2) is an appliance casing.

21. A switching device according to claim 17, wherein the support (28) is substantially formed by a support level (29) mounted in articulated manner in a pivot axis, said support lever determining a longitudinal direction.

22. A switching device according to claim 17, wherein the support has two remote sides, said support (28) carrying the counter-stop (37) respective the switching spring (31) on one of said sides and engaging on the cam disk (40) with the other of said sides.

23. A switching device according to claim 17, wherein the support (28) is mounted in articulated manner with a bending spring (30).

24. A switching device according to claim 21, wherein the switching element (14) of switching mechanism (12) is located at a greater distance from the pivot axis of the support lever (29) with respect to the longitudinal direction of the support lever (29) than the counter-stop (37).

25. A switching device according to claim 21, wherein the cam disk (40) of adjusting device (39) is engaging the support lever (29) between the counter-stop (37) and the switching element (14).

26. A switching device according to claim 1, wherein the switching device is constructed as an intermittened operating power control device (1), the switching mechanism (12) having a switching element (14) controlled by a temperature-dependen control circuit.

27. A switching device according to claim 26, wherein a heating resistor (16) is provided for acting on a thermomechanical switching member (13) for operating the switching element (14), means being provided for switching said heating resistor (16) with the appliance switch (6).

28. A switching device according to claim 27, wherein the thermomechanical switching member (13) is a thermobimetal (15) having two ends, said thermobimetal (15) carrying the switching element (14) in lever-like manner in the vicinity of one of said ends.

29. A switching device according to claim 27, wherein the heating resistor (16) is arranged directly on the switching member (13).

30. A switching device according to claim 27, wherein the switching member (13) is mounted in articulated manner on the basic body (2).

31. A switching device according to claim 27, wherein the switching member (13) is mounted by means of a bending spring (18).

32. A switching device according to claim 27, wherein a substantially U-shaped leaf spring is provided, said leaf spring having a cross member (61) connecting two projecting spring legs, said cross member (61) being mounted on the basic body (2), one of said spring legs carrying the support lever (29) and the other of said spring legs carrying the switching member (13).

33. A switching device according to claim 1, wherein the appliance switch (6) and the switching mechanism (12) are combined to provide a preassembled constructional unit (62) excluding the counter contact (36).

34. A switching device according to claim 33, wherein the constructional unit has a support body (19) fixed to the cross member (61) of the leaf spring, said constructional unit being supported on the basic body (2) by means of an inserted connection.

35. A switching device according to claim 1, wherein the appliance switch (6) is arranged in a substantially freely projecting manner.

36. A switching device according to claim 1, wherein the switching mechanism (12) is arranged in a substantially freely projecting manner.

37. A switching device according to claim 1, wherein an ambient temperature is defined, a compensating device (20) being provided for compensating the adjustment of the appliance switch (6) respective the switching element (14) as a function of the ambient temperature.

38. A switching device according to claim 37, wherein the compensating device (20) has a thermobimetallic temperature sensor (26) acting on the switching member (13).

39. A switching device according to claim 37, wherein the compensating device (20) is a component of the preassembled constructional unit (62).

40. A switching device according to claim 27, wherein said heating resistor (16) has electrical connecting leads, one of said electrical connecting leads being formed by a connecting spring (22) having spring legs.

41. A switching device according to claim 40, wherein the connecting spring (22) has a helical portion engaging on a support mandrel (23) of the basic body (2), one of said spring legs resiliently engaging on said heating resistor (16), another one of said spring legs (24) engaging on a bearing member (25) of an additional break contact (11) in electrically conductive manner.

42. A switching device according to claim 2, wherein said manual actuator operates via a setting spindle (8), a locking means for said setting spindle (8) being provided for releasably locking said setting spindle (8) in the switch-off position, said setting spindle (8) being axially movable for releasing said locking means.

43. A switching device according to claim 42, wherein the locking means has two locking means provided by a locking cam (65) axially engagable in a locking opening (70), said locking members on the one hand being provided on a part fixed with respect to the basic body (2) and on the other hand being provided on an annular disk (66) axially displaceable with the setting spindle (8).

44. A switching device according to claim 43, wherein an abutment ring (67) engaging in an annular groove (68) of the setting spindle (8) is provided, a substantially sloping abutment shoulder (69) for supportedly resting said annular disk (66) against said abutment ring being provided, a return spring (71) having a return tension being provided, said return tension biasing said abutment ring (67) in a radially constricting manner.

45. A switching device according to claim 43, wherein the locking cam (65) is constructed in one piece with a component of the basic body (2).

46. A switching device according to claim 43, wherein the locking cam (65) is punched respective bent from a securing lid (5) made from a sheet metal-like material.

47. A switching device according to claim 43, wherein the locking cam (65) has a cam height, said setting spindle (8) being axially displaceable with respect to the cam disk (40) of the adjusting device (39) at least by the cam height of the locking cam (65).

* * * * *